US008807228B2

(12) United States Patent
Martin et al.

(10) Patent No.: US 8,807,228 B2
(45) Date of Patent: Aug. 19, 2014

(54) FRICTION REDUCTION MECHANISM FOR A DOWNHOLE RELEASE ASSEMBLY

(75) Inventors: Brandon Martin, Katy, TX (US); Douglas W. Grant, Cedar Creek, TX (US); Keith R. Nelson, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 174 days.

(21) Appl. No.: 13/435,011

(22) Filed: Mar. 30, 2012

(65) Prior Publication Data

US 2013/0255964 A1 Oct. 3, 2013

(51) Int. Cl.
*E21B 23/00* (2006.01)

(52) U.S. Cl.
USPC .... 166/377; 166/301; 166/242.2; 166/250.13

(58) Field of Classification Search
CPC ..... E21B 23/00; E21B 31/00; E21B 31/002; E21B 31/107; E21B 17/023; E21B 17/026; E21B 17/06
USPC ..... 166/377, 301, 242.2, 250.13; 285/920; 384/58
See application file for complete search history.

(56) References Cited

U.S. PATENT DOCUMENTS

| | | | | |
|---|---|---|---|---|
| 2,678,805 | A * | 5/1954 | Sutliff | 175/297 |
| 5,086,844 | A | 2/1992 | Mims et al. | |
| 5,568,836 | A | 10/1996 | Reid | |
| 6,142,237 | A | 11/2000 | Christmas et al. | |
| 6,431,269 | B1 * | 8/2002 | Post et al. | 166/65.1 |
| 7,007,756 | B2 * | 3/2006 | Lerche et al. | 166/297 |
| 7,395,881 | B2 | 7/2008 | McKay et al. | |
| 7,407,005 | B2 | 8/2008 | Zanca et al. | |
| 7,426,964 | B2 | 9/2008 | Lynde et al. | |

OTHER PUBLICATIONS

International Search Report and Written Opinion for International Application No. PCT/US2013/04516 dated Jun. 25, 2013.

* cited by examiner

*Primary Examiner* — Jennifer H Gay
*Assistant Examiner* — George Gray
(74) *Attorney, Agent, or Firm* — Trevor Grove; Jody Lynn DeStefanis; Cathy Hewitt

(57) ABSTRACT

A mechanism to enhance disengagement of release assembly portions from one another when disposed in a well. The mechanism may be disposed at an internal rod of the release assembly and configured to prevent frictional resistance to shifting of the rod.

13 Claims, 6 Drawing Sheets

FRICTION REDUCTION MECHANISM FOR A DOWNHOLE RELEASE ASSEMBLY

BACKGROUND

Exploring, drilling, completing, and operating hydrocarbon and other wells are generally complicated, time consuming and ultimately very expensive endeavors. In recognition of these expenses, added emphasis has been placed on well access, monitoring and management throughout its productive life. Ready access to well information as well as well intervention may play critical roles in maximizing the life of the well and total hydrocarbon recovery. As a result, downhole tools are frequently deployed within a given hydrocarbon well throughout its life. These tools may include logging tools to provide well condition information. Alternatively, these tools may include devices for stimulating hydrocarbon flow, removing debris or scale, or addressing a host of other well issues.

The above noted downhole tools are generally delivered to a downhole location by way of a well access line, such as a wireline cable, drill pipe, coiled tubing, slickline, etc. Regardless, once positioned downhole at the end of the well access line, a well application may be employed by such a tool. A winch or other appropriate surface equipment may then be employed to withdraw the well access line and tool from the well. However, in many cases the tool may be stuck in place downhole. This may be due to the presence of an unforeseen obstruction, unaccounted for restriction, differential sticking of the tool against the well wall, a malfunctioning tractor, or a host of other reasons. Indeed, with the presence of increasingly deeper and more deviated wells, the likelihood of a downhole tool becoming stuck merely due to the depth and architecture of the well alone is increased.

Regardless of the particular reason for the sticking of the downhole tool, continued efforts to withdraw the line may lead to line or tool damage. Additionally, the risk of breaking the line at some, seemingly random, intermediate location and leaving potentially several thousand feet of line in the well may be of concern. Thus, in order to help avoid a circumstance in which the line is broken, a release mechanism is generally incorporated into the assembly which accommodates the downhole tool. Therefore, the assembly may be broken apart at a known location and surface equipment employed to pull the line out of the well, leaving only the downhole tool and part of the broken assembly behind. A subsequent fishing application may take place in order to dislodge and retrieve the tool and assembly portion.

A common release mechanism involves incorporating a mechanical "weakpoint" or separable housing into the noted assembly. The weakpoint may be broken once a predetermined load is applied as a result of the axial force of pulling on the line from surface. Unfortunately, employing a weakpoint in this manner may still lead to some degree of damage to the tool, line or tractor where utilized. For example, in an application where the weakpoint is broken in a horizontal well section several thousand feet below the oilfield surface, the line may react in a sudden slingshot fashion. That is, the line may snap back with significant force, perhaps damaging itself, the tractor, or high dollar tools such as sophisticated imaging or other measurement equipment.

In order to minimize potential damage and unpredictability of weakpoint release mechanisms, an electronically controlled release device (ECRD) may be utilized. That is, rather than rely on the breaking of a tensile stud through mere force as in the case of a weakpoint assembly, an electronic actuator of the assembly may effect release in response to a signal sent from equipment at the oilfield surface. Thus, a more controlled release may be achieved.

The controlled release via the ECRD allows the operator to even introduce a degree of slack in the line in advance of signaling the release. Thus, in theory, when the release occurs, the line is unlikely to react in the slingshot manner noted above. In fact, current ECRD designs inherently require that the load on the assembly via the line be substantially under 150 lbs. or so in order to ensure that the release takes place. This is due to internal interaction of release components which naturally grip one another and discourage release where a significant axial load is present on the line. More specifically, a significant axial load on the line may translate to a radial load on collet fingers of one half of the assembly which secure an actuator rod of another half of the assembly, thereby preventing release even where such has been signaled from surface.

Unfortunately, the safety measure of preventing release in circumstances of high axial load renders the ECRD unreliable where the operator's ability to reduce the load is compromised. For example, where an application involves tractoring the assembly and tools through a horizontal well section, a resultant high tension sticking may leave the operator unable to alter the line tension. That is, even where the operator introduces additional line to the well it may very well collect at the heel of the horizontal well section. Thus, the tension on the stuck portion of the line may remain high. As such, even where signaled to release, the mechanical design of the ECRD may prevent it from allowing the release to occur. As a result, the safety advantages of controlled release through the ECRD are often foregone where horizontal or highly deviated wells are involved.

SUMMARY

A release assembly for a well access line is disclosed. The assembly includes at least two different portions configured for separation from one another. In particular, one of the portions makes use of elongated members that interface the second portion when it is coupled to the first. A release actuator is coupled to one of the portions and a friction reduction mechanism is disposed at the indicated interface of the members and second portion. As such, the friction reduction mechanism may be employed to enhance the separation of the portions upon release actuation by the actuator.

DETAILED DESCRIPTION

Embodiments are described with reference to certain downhole tool operations at an oilfield. For example, logging operations with a downhole logging tool in a well at an oilfield are described throughout. However, alternate downhole operations and tools may be utilized in conjunction with embodiments of a "release assembly" as described herein. Regardless, embodiments of the release assembly include a friction reduction mechanism to enhance a controlled or directed release, such as through electronic signaling by an operator at an oilfield surface. That is, even in circumstances where a substantial load is present on the mechanism, electronic or other directed release may proceed without concern over internal friction of the assembly preventing the release.

Figure 1:
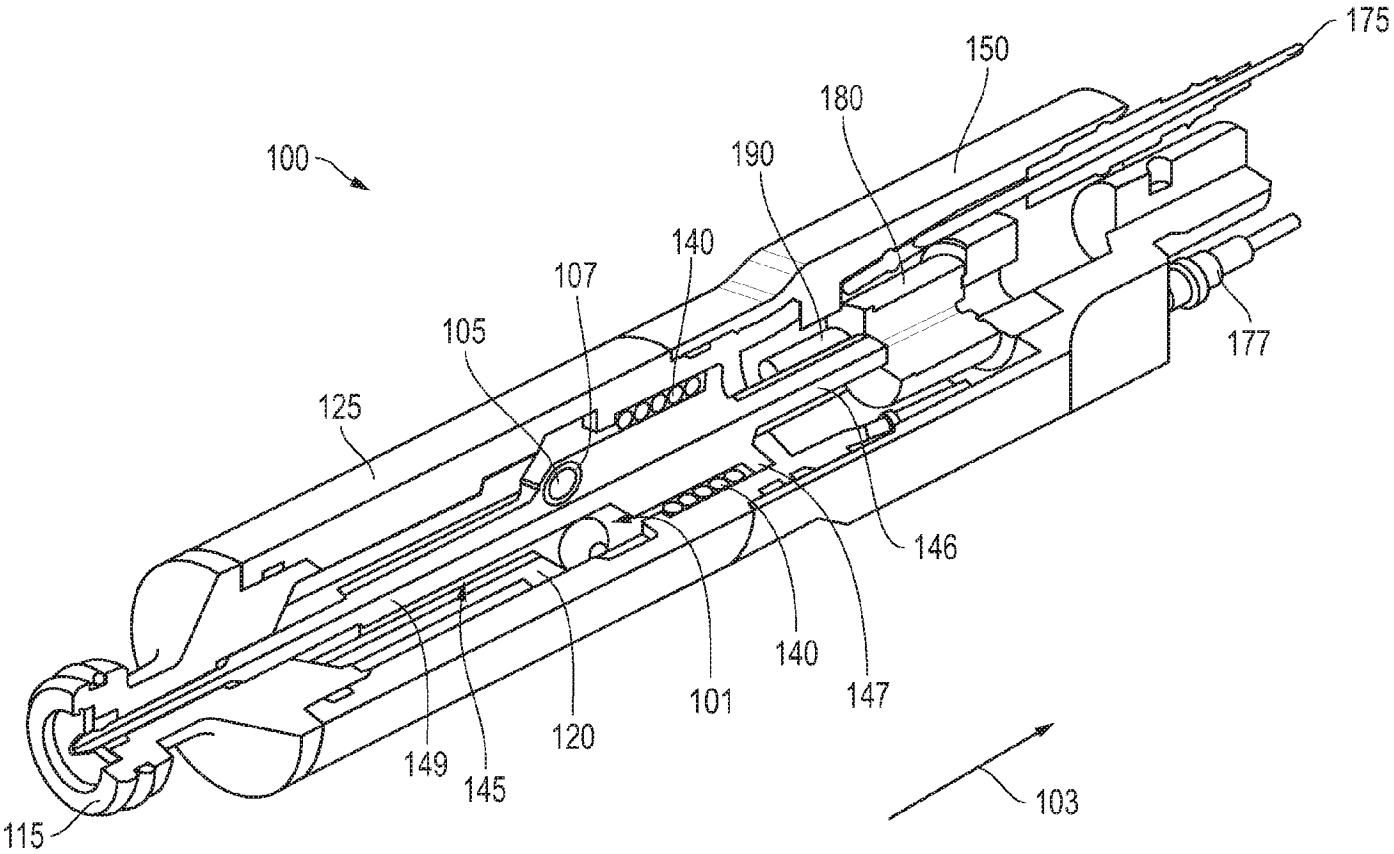
FIG. 1 is a perspective view of a downhole release assembly employing an embodiment of a friction reduction mechanism to enhance a controlled release.

Referring now to FIG. 1, a perspective view of a downhole release assembly 100 is depicted which incorporates a friction reduction mechanism 101. The mechanism 101 is configured to enhance a directed and controlled release or separation of one housing portion 115 from others 125, 150. For example, with added reference to FIG. 3, a downhole tool 200 coupled to the assembly 100 may become stuck in a well 380. When such circumstance arises, the assembly 100 may be broken apart to allow removal of the more uphole portion 115 of the assembly 100 along with a well access or delivery line 355 and any more uphole equipment 355.

In the embodiments depicted herein, the noted release or separation is achieved in a directed manner such as through electronic or other non-tension based communications. More specifically, remote electronic signaling may be relayed through wiring 175 at terminals 177 of the assembly 100 which eventually direct components of the assembly 100 to allow for a release as described. This is in contrast to alternate conventional tension-based release assemblies, such as those incorporating a 'weakpoint' via a stud configured to break upon imparting of a known axial load on the assembly 100 (e.g. by way of pulling up on the line 355 of FIG. 3). Thus, a more controlled release may be achieved which may avoid a degree of equipment damage that might otherwise result from the sudden high-tension breakage of the assembly 100.

With reference to the more specific components which allow for the described release, an actuator rod 145 is shown disposed centrally within the assembly 100. The rod 145 includes a main body 147 disposed in a central housing 125 of the assembly 100. An elongated portion 149 of the rod 145 runs toward an uphole housing 115 of the assembly 100 and an extension 146 of the rod 145 runs toward a downhole housing 150 of the assembly 100. More specifically, the rod 145 is held in place between a spring 140 about the main body 147 and a bobbin assembly 180 located in the downhole housing 150. Thus, even though a spring force is applied to the rod 145 in a downhole direction (see arrow 103) the bobbin assembly 180 prevents downward movement thereof Notably, the central 125 and downhole 150 housings may remain associated following release as detailed herein. Thus, for illustrative purposes, they may be separately identified although they may be considered part of the same unitary housing.

Figure 4A:
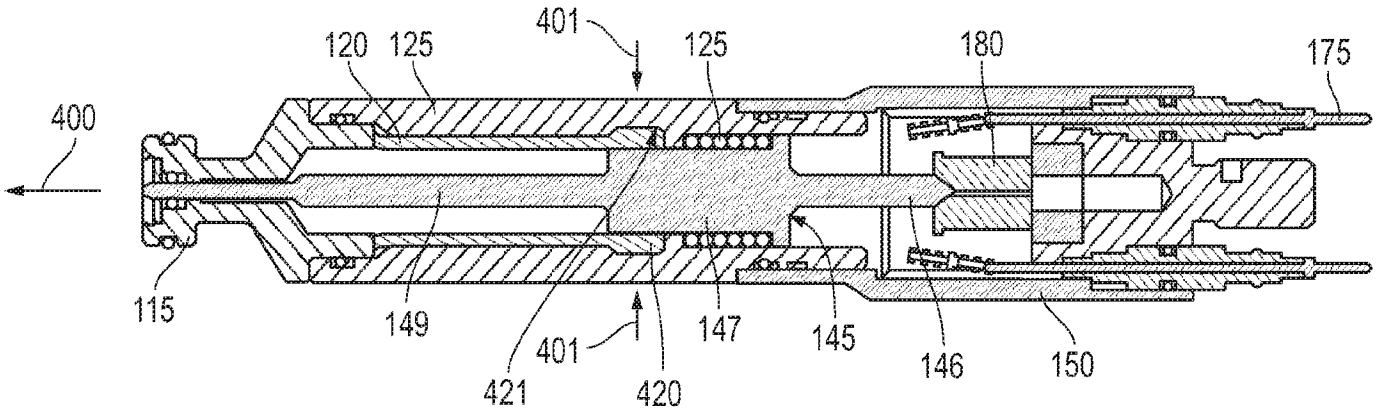
FIG. 4A (Prior Art)
FIG. 4A is a side cross-sectional view of a prior art release assembly lacking any friction reduction mechanism.

With added reference to FIG. 4A, the rod 145 is held in place as noted above. Thus, a retention mechanism such as the depicted collet array 120 of the uphole housing 115 is also held in place. As such, the uphole housing 115 itself remains secured to the central 125 and downhole 150 housings. Note the profile of the collet array 120 which includes projections 420 extending into a circumferential recess 421 of the central housing 125 to prevent separation of the array 120 from the housing 125 even upon axial load in an uphole direction (see arrow 400).

Continuing with reference to FIGS. 1 and 4A, focus is drawn to the profile of the actuator rod 145 and its manner of interfacing the collet array 120 at its main body 147. Namely, it is apparent that if the rod 145 is allowed to shift in a downhole direction (arrow 103), it may interface the array 120 with its narrower elongated portion 149. Thus, a sufficient axial pull (arrow 400) would allow for deflection of individual fingers, or elongated members, of the collet array 120 away from the central housing 125 and toward the elongated portion 149. As such, this pull in the noted direction 400 would result in separation of the uphole housing 115 from the remainder of the release assembly 100.

Returning to specific reference to FIG. 1, the assembly 100 is configured to employ the described release technique in a manner that ensures shifting of the rod 145 is not prevented by friction at the interface of the main body 147 and the array 120. For example, as with a conventional ECRD, the bobbin assembly 180 is configured to be fractured in order to allow shifting of the rod 145 in the downhole direction 103. However, the release assembly 100 is also equipped with the noted friction reduction mechanism 101 at the interface of the body 147 and array 120. Thus, unlike a more conventional release assembly, such as that of FIG. 4A, the assembly 100 of FIG. 1 is assured of spring induced rod shifting, once the structural resistance of the bobbin assembly 180 is removed. Stated another way, without the intact bobbin assembly 180, not enough frictional resistance is possible at the noted interface to prevent the downhole rod shifting in the depicted direction 103.

Continuing with reference to FIG. 1, fracturing or other structural elimination of the bobbin assembly 180 is actuated by electronic or other signaling of a heater 190. For example, in one embodiment, the assembly 180 is made up of quartered and soldered together structural elements that may be reseparated by way of heating via the heater 190. Thus, once the elements separate, collapse of the extension 146 and remainder of the rod 145 in the noted direction 103 is allowed.

Force for the shifting of the rod 145 is supplied by the spring 140 whereas frictional resistance to this force is substantially eliminated by the presence of the friction reduction mechanism 101 as described. Force for the shifting of the rod may be supplemented by a hydrostatic seal in the housing of the uphole portion 115. More specifically, in the embodiment shown, the mechanism 101 may be of a roller based variety with wheels 105 disposed in sleeve bearings 107 at the main body 147 of the rod 145. Thus, upon removal of the bobbin assembly resistance, the body 147 may roll along the interface with the collet array 120, uninhibited by any significant frictional buildup thereat.

Of course, the mechanism 101 may employ alternate forms of rollers than the depicted wheels 105. For example, in one embodiment bearings, perhaps spring biased, may be disposed at the indicated interface. Indeed, in yet another embodiment, the friction reduction mechanism 101 may take the forms of varying surface enhancements at the main body 147 and collet array 120. For example, surface materials of reduced coefficients of friction may be employed at the interface in conjunction with dimensional modifications of the array 120 to promote responsive deflection for individual fingers thereof.

Figure 2:
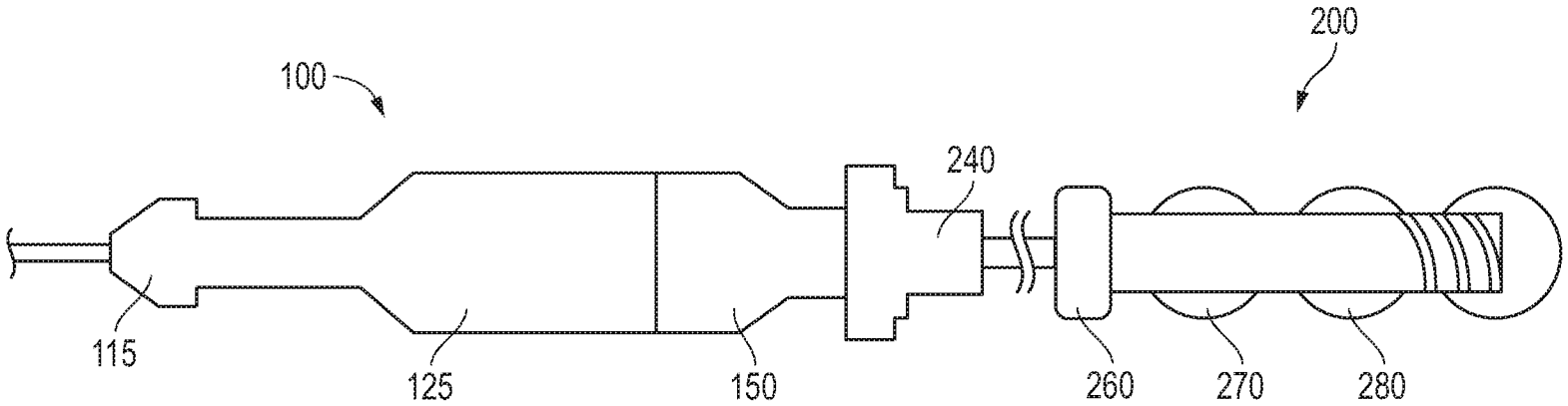
FIG. 2 is a side schematic view of the assembly coupled to a downhole tool for use in a well application.

Referring now to FIG. 2 a side schematic view of the assembly 100 is shown coupled to a downhole tool 200 for use in a well application. The release assembly 100 includes the described housing portions 115, 125, 150 along with a coupling 240 for accommodating the noted downhole tool 200 and other devices (see tractor 357 of FIG. 3). In the embodiment shown, the tool 200 is a logging tool outfitted with a variety of implements 260, 270, 280 for acquiring well profile data. However, in other embodiments a host of different types of tools may be utilized in conjunction with the release assembly 100.

Continuing with reference to FIG. 2, the tool 200 may include a saturation implement 260 to establish fluid flow information, an imaging implement 270, an accelerometer 280, and other implements for attaining downhole information. Regardless, as indicated above, the uphole housing 115 of the release assembly 100 is separable from other portions 125, 150 thereof More specifically, with added reference to FIG. 3, release may be directed or actuated, for example, by a signal sent from an oilfield surface 315. Therefore, in circumstances where the tool 200 has become stuck, the uphole housing 115 and wireline 355, or other line conveyance, may be controllably released and removed from the well 380. This may then be followed by a subsequent fishing application for retrieval of the stuck tool 200 (and tractor 357 in the embodiment of FIG. 3). In an embodiment, the release assembly 100 may be disposed at various locations along a tool string, such as between the tractor 357 and the tool 200, downstream of the tool 200 or at other suitable locations in a tool string, as will be appreciated by those skilled in the art.

Figure 3:
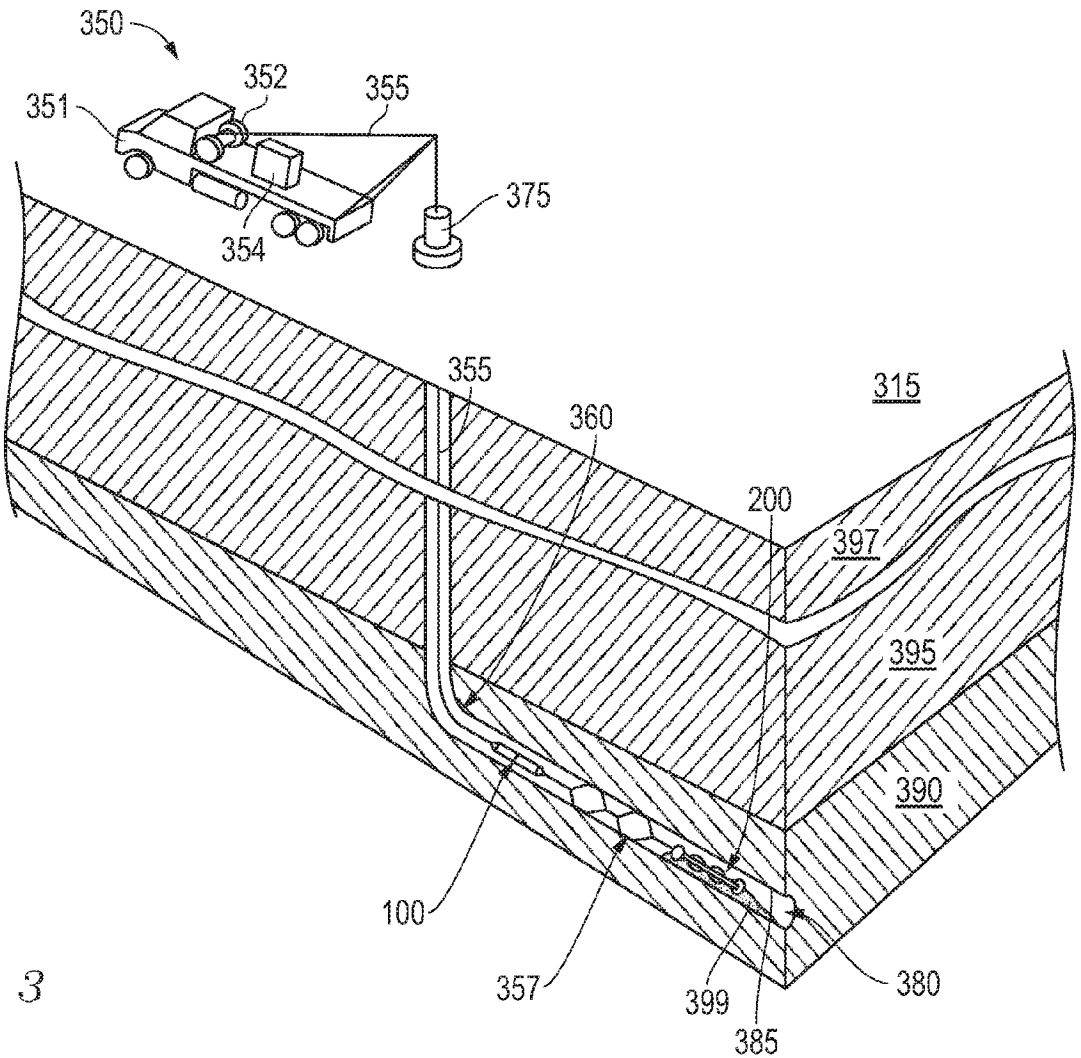
FIG. 3 is an overview depiction of an oilfield accommodating a well with the assembly disposed therein.

Continuing now with direct reference to FIG. 3, an overview of an oilfield 315 is depicted accommodating a well 380 with the above-noted release assembly 100 and tool 200 disposed therein. More specifically, the tool 200 is shown stuck in debris 399 within a horizontal section of the well 380. Due to the horizontal nature of the well section, a reciprocating tractor 357 is provided which may interact with the well wall 385 in an inchworm-like fashion so as to advance the tool 200 and assembly 100 into the depicted location.

In the embodiment shown, the well 380 traverses various formation layers 397, 395, 390 in reaching the horizontal well section. A well access line in the form of a wireline cable 355 is provided in order to maintain connection with surface equipment 350 at the surface of the oilfield 315. More specifically, a wireline truck 351 accommodating a spool 352 of cable 355 and a control unit 354 may be delivered to the well site. Thus, the cable 355 may be run through a well head 375 and into the well 380 as shown. This cable 355 may be utilized for powered communications with each of the downhole devices. Thus, the control unit 354 may be employed by an operator to direct tractoring, logging and even the actuation of the release assembly 100 where needed as detailed above.

Continuing with reference to FIG. 3, once the tool 100 becomes stuck or the tractor malfunctions, a controlled breaking of the release assembly 100 may be directed from surface. That is, rather than simply pulling with extreme force on the cable 355, a controlled breaking at the assembly 100 may be carried out. This may be particularly advantageous and more practical where the cable 355 has rounded a heel 360, perhaps minimizing the effect of increasing tension on the cable 355 from surface.

Further, even though the release assembly 100 is of an actuatable non-tensile variety, any uncontrolled tension on the cable 355 is unlikely to translate into internal friction sufficient to prevent release. For example, as noted above and detailed below with respect to FIG. 4A, a conventional ECRD may require a reduction in axial load in order to allow for release. However, given the horizontal nature of the well 380 and the presence of the intervening tractor 357 the introduction of slack in the cable 355 might result in accumulation of cable 355 at the heel 360 without affect on axial load at the location of the assembly 100. Nevertheless, in spite of this potentially unalterable high load circumstance, embodiments of the release assembly 100 would retain the ability to achieve release due to the internal friction reduction mechanism 101 of FIG. 1.

Figure 4B:
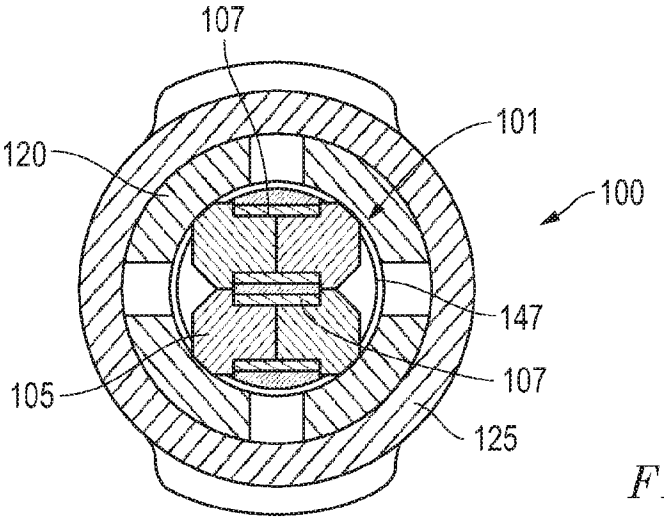
FIG. 4B is a front cross-sectional view of the friction reduction mechanism of FIG. 1 incorporated into the release assembly.

Referring now to FIGS. 4A and 4B, side and front cross-sectional views of release assemblies are depicted. More specifically, a prior art release assembly is depicted in FIG. 4A which lacks the friction reduction mechanism 101 which is incorporated into the assembly 100 of FIG. 4B. Thus, upon close examination of the different assemblies, the particular positioning and mechanics of the mechanism 101 within an assembly 100 of embodiments herein may be clearly understood.

Continuing with reference to FIGS. 4A and 4B, the prior art release assembly of FIG. 4A lacks the friction reduction mechanism 101 of FIG. 4B. More specifically, friction at the interface of the collet array 120 and the main body 147 of the actuator rod 145 is unaffected by any such mechanism 101. Rather, the interfacing surfaces of the array 120 and body 147 interface in a frictional manner which may affect the ability of the rod 145 to shift toward the bobbin assembly 180 for release as detailed above. In fact, an axial load imparted on the assembly in an uphole direction 400 may translate to inner radial forces 401 on the array 120 such that an actual grip may be imparted on the body 147. Without some sort of frictional reduction measures at the noted array 120/body 147 interface, this grip may further complicate the ability of the rod 145 to shift and effectuate the release. Thus, given the likelihood of certain circumstances presenting a significant axial load that may not readily be reduced (see FIG. 3), a friction reduction mechanism 101 such as that of FIG. 4B may be of substantial benefit.

With specific reference to FIG. 4B, a front cross-sectional view of the friction reduction mechanism 101 of FIG. 1 is now shown incorporated into a release assembly 100. In particular, the mechanism 101 is positioned right at the interface of the collet array 120 and the main body 147 of the actuator rod 145. Indeed, with added reference to FIG. 5A, most of the actuator rod 145 is obstructed by the wheels 105 of the mechanism 101. However, the orientation of the mechanism 101, wheels 105 and their incorporation into the body 147 of the rod 145 may be clearly viewed at FIG. 5A.

Figure 5B:
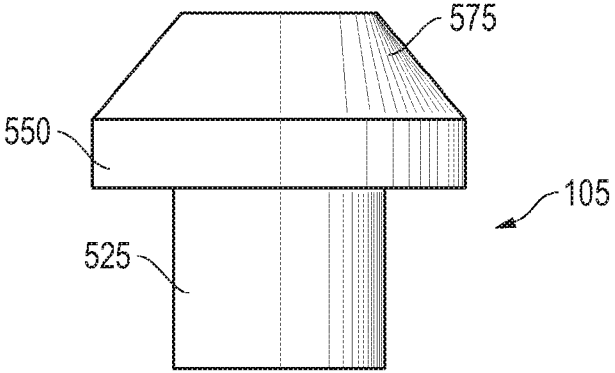
FIG. 5B is a side view of a roller of the mechanism.
Figure 5A:
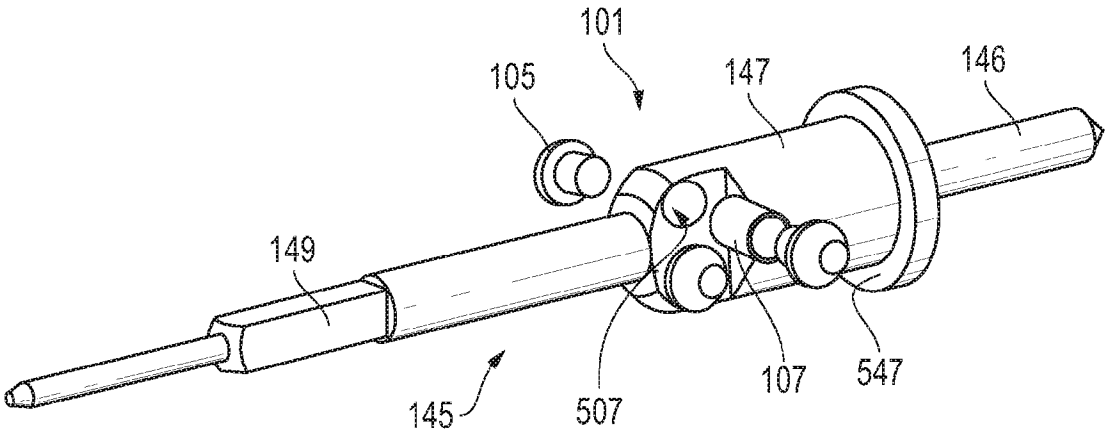
FIG. 5A is an exploded perspective view of the friction reduction mechanism of FIG. 4B disposed at an actuator rod of the assembly.

Continuing with reference to FIGS. 4B and 5A, the wheels 105 are disposed at the main body 147 within sleeve bearings 107 which are configured to display minimal coefficient of friction so as to allow rolling of the wheels 105. For example, with specific reference to FIGS. 4A and 4B, an actuated release may be accompanied by a pull on the uphole hosing 115 away from the central housing 125 (see arrow 400). In looking at the orientation of the assembly 100 in FIG. 4B, this would translate into a pull on the collet array 120 up or out of the page. Thus, corresponding inward rolling of the wheels 105, responsive to any inward radial forces from the array 120, would replace any frictional resistance to such pull.

In one embodiment, a degree of friction or grip is intentionally provided between an outer surface 575 of the wheels 105 and the inner surface of each corresponding collet finger of the array 120 (see also FIG. 5B). That is, so long as the bearings 107 afford sufficient rotation to the wheels 105, their engagement with the array 120 may actually serve to further promote rolling release of the uphole housing 115 from the assembly 100. Along these lines, each wheel 105 may also be configured to engage adjacent wheels 105, one at its side and the other at its rolling surface, such that the entire mechanism 100 acts in shared concert in a gear-like fashion.

Returning to FIGS. 4A & 4B, with the friction reduction mechanism 100 disposed at the interface of rod 145 and array 120 as described, an actuated release may now take place without undue concern over frictional resistance, particularly due to lack of control over axial load (e.g. at 400). Thus, a signal may be sent from surface reaching wiring 175 which directs a fracture of a bobbin assembly 180. As such, a spring driven collapse of the rod 145 into the downhole housing 150 from the central housing 125 may take place as ensured by the presence of a friction reduction mechanism 101. Therefore, pull in the uphole direction 400 may translate into inward deflection of individual fingers of a collet array 120, thereby allowing for separation of the uphole housing 115 from the assembly. A controlled release may thus be achieved.

Referring now to FIGS. 5A and 5B exploded and side views of the actuator rod 145 and wheels 105 of the friction reduction mechanism 101 are respectively depicted. More specifically, FIG. 5A provides visual clarity as to how an embodiment of the mechanism 101 may be accommodated by the main body 147 of the rod 145. Indeed, in this view, bearing recesses 507 are shown for accommodating the detailed sleeve bearings 107 which allow for spring powered rolling of the rod 145 upon actuation, which may be supplemented by a hydrostatic seal in the housing of the uphole portion 115. Further, with added reference to FIG. 1, this view also reveals a spring interface surface 547 upon which the spring 140 may act to initiate this directional shift of the rod 145 (see arrow 103).

With more specific reference to FIG. 5B, an individual roller 105 of the mechanism 101 of FIG. 5A is shown revealing its different surfaces 525, 550, 575. With added reference to FIG. 1, a outer surface 575 is provided for interfacing the array 120 detailed hereinabove. Thus, effective frictional reduction, as between array 120 and rod 145, is provided. Along these same lines, an extension from the wheel 105 includes a bearing surface 525 which is of sufficiently low coefficient of friction relative a bearing sleeve 107 so as to permit effective rolling. However, as alluded to above, and with added reference to FIG. 4B, this extension may also contact an adjacent wheel 105 so as to promote shared rolling in the same direction. Thus, by the same token, the contact surface 550 may also engage another adjacent wheel 105 in a gear-like fashion to promote inward rolling of the wheels 105 toward one another. In one embodiment, this surface 550 may even include teeth to promote such concerted rolling along with rolling engagement relative the array 120.

Figure 6:
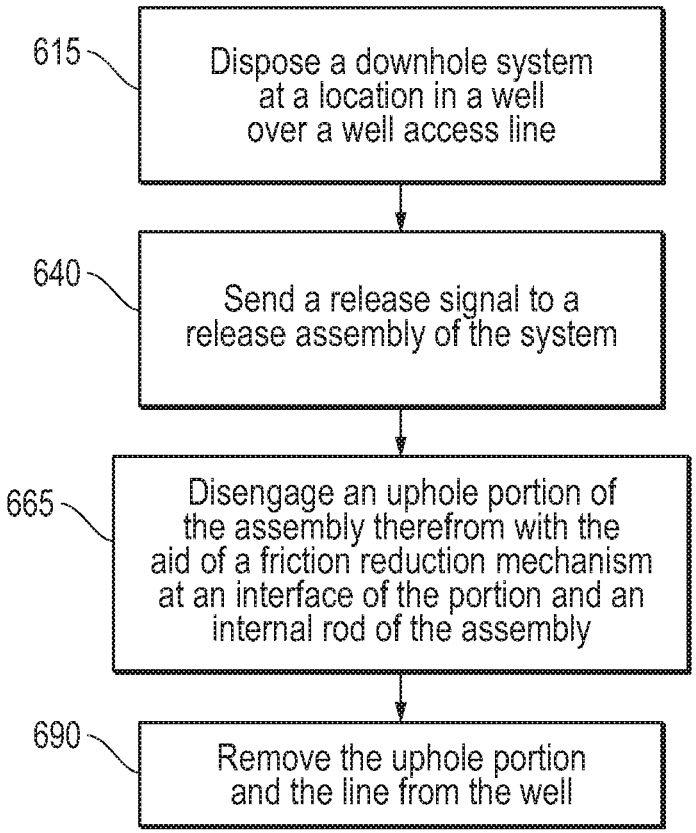
FIG. 6 is a flow-chart summarizing an embodiment of employing a release assembly with friction reduction mechanism for enhancing a controlled release at a downhole location in a well.

Referring now to FIG. 6 a flow-chart is depicted summarizing an embodiment of employing a release assembly with friction reduction mechanism for enhancing a controlled release at a downhole location in a well. That is, a system incorporating the release assembly may be deployed in a well and a subsequent signal for release directed to the assembly (see 615, 640). As detailed herein, such deployment is likely over a wireline cable. However, embodiments detailed herein may be utilized over coiled tubing, slickline or other forms of well access line. Further, signaling directed at the release assembly may be wireless in nature such as through pressure pulse, setting of a timer, etc.

Continuing with reference to FIG. 6, receipt of the release signal may be in the form of actuating a controlled disengagement of an uphole portion of the assembly as indicated at 665. This may include the fracturing of an internal bobbin assembly or other techniques for shifting an internal rod of the assembly as described hereinabove. Regardless, as indicated at 665, a friction reduction mechanism may aid in the rod shifting so as to allow for the disengagement. Thus, with the uphole portion disengaged it may be removed from the well by in conjunction with, and by way of, the well access line as noted at 690. A subsequent fishing application may then be undertaken for safe removal of remaining equipment of the downhole system.

Embodiments detailed herein provide an ECRD or other controlled downhole release assembly that is not solely reliant on the breaking of a tensile member to achieve release. Once more, embodiments of the release assembly detailed herein may reliably attain release even where an operator's ability to reduce axial load on the assembly is compromised, for example due to the architecture of the well or nature of the delivery equipment. Thus, advantages of employing a controlled downhole release assembly need not be forgone in the face of challenging well architecture or other factors which may tend to affect axial load on the assembly.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. Furthermore, the foregoing description should not be read as pertaining only to the precise structures described and shown in the accompanying drawings, but rather should be read as consistent with and as support for the following claims, which are to have their fullest and fairest scope.

We claim:

1. A well access line release assembly comprising:

a collet array coupling a housing portion with another housing portion;

an actuator rod operatively disposed within at least one of the housing portions;

wherein the actuator rod moves relative to the collet array;

a sleeve bearing in a main body of the actuator rod; and a wheel comprising an outer surface, a contact portion, and an extension with a bearing surface, wherein the outer surface operatively engages the collet array and the bearing surface operatively engages the sleeve bearing.

2. The assembly of claim 1 further comprising a first bearing sleeve having a first wheel and a second wheel located therein, and a second bearing sleeve having a third wheel and fourth wheel located therein.

3. The assembly of claim 2, wherein contact portions of the first wheel and third wheel engage one another, and wherein contact portions of the second wheel and the fourth wheel engage one another.

4. The assembly of claim 3, wherein extensions of the first wheel and second wheel engage one another, and extensions of the third wheel and fourth wheel engage one another.

5. The assembly of claim 3, wherein the contact portions of the wheels comprise teeth.

6. A downhole system for disposal in a well and comprising:

a well access line;

a release assemble connected with the well access line, wherein the release assemble comprises:

a collet array coupling a housing portion with another housing portion;

an actuator rod operatively disposed within at least one of the housing portions; wherein the actuator rod moves relative to the collet array;

a sleeve bearing in a main body of the actuator rod; and a wheel comprising an outer surface, a contact portion, and an extension with a bearing surface, wherein the outer surface operatively engages the collet array and the bearing surface operatively engages the sleeve bearing; and a downhole tool connected with the release assembly.

7. The assembly of claim 6, further comprising a first bearing sleeve having a first wheel and a second wheel located therein, and a second bearing sleeve having a third wheel and fourth wheel located therein.

8. The assembly of claim 7, wherein contact portions of the first wheel and third wheel engage one another, and wherein contact portions of the second wheel and the fourth wheel engage one another.

9. The assembly of claim 7, wherein extensions of the first wheel and second wheel engage one another, and extensions of the third wheel and fourth wheel engage one another.

10. The assembly of claim 7, wherein the contact portions of the wheels comprise teeth.

11. The system of claim 6, further comprising a tractor coupled to the well access line and the release assembly.

12. The system of claim 6, wherein the well access line is selected from a group consisting of: wireline, slickline, and coiled tubing.

13. The system of claim 6, wherein said downhole tool is a logging tool.

* * * * *